US006829805B2

(12) United States Patent
Yang

(10) Patent No.: US 6,829,805 B2
(45) Date of Patent: Dec. 14, 2004

(54) LOCKING DEVICE FOR EXHAUST FILTER OF VACUUM CLEANER

(75) Inventor: Byung-Sun Yang, Changwon-Gyeongnam (KR)

(73) Assignee: LG Electronics Inc., Seoul (KR)

( * ) Notice: Subject to any disclaimer, the term of this patent is extended or adjusted under 35 U.S.C. 154(b) by 367 days.

(21) Appl. No.: 10/150,980

(22) Filed: May 21, 2002

(65) Prior Publication Data

US 2003/0115713 A1 Jun. 26, 2003

(30) Foreign Application Priority Data

Dec. 20, 2001 (KR) ..... 2001-82129

(51) Int. Cl.[7] ..... A47L 9/10; A47L 9/12

(52) U.S. Cl. ..... 15/347; 15/327.2; 55/359; 55/511; 55/DIG. 3

(58) Field of Search ..... 15/347, 350–353, 15/327.1, 327.2, 327.6, 327.7; 55/DIG. 3, 359, 495, 511

(56) References Cited

U.S. PATENT DOCUMENTS 3,841,067 A * 10/1974 Kato et al. ..... 55/300
4,577,365 A * 3/1986 Yuen ..... 15/339
5,074,006 A * 12/1991 Eremita ..... 15/344
5,810,911 A * 9/1998 Behrendt et al. ..... 95/278
5,946,771 A * 9/1999 Bosyj et al. ..... 15/347
6,341,404 B1 * 1/2002 Salo et al. ..... 15/353
6,540,804 B1 * 4/2003 Wennerstrom ..... 55/472
2002/0162188 A1 * 11/2002 Harmen ..... 15/353
2002/0166200 A1 * 11/2002 Conrad et al. ..... 15/353

* cited by examiner

*Primary Examiner*—Terrence R. Till
(74) *Attorney, Agent, or Firm*—Fleshner & Kim, LLP

(57) ABSTRACT

The present invention relates to a locking device for mounting an exhaust filter of a vacuum cleaner on an exhaust filter cover. According to the present invention, there is provided a locking device for an exhaust filter of a vacuum cleaner, comprising a locking device for an exhaust filter of a vacuum cleaner, comprising an exhaust filter cover mounted on one side surface of a main body of the vacuum cleaner, and including a plurality of exhaust holes and a plurality of mounting grooves formed on an inner surface of a cylindrical sidewall of the exhaust filter cover; and a filter including a filtering portion for filtering air, and engagement protrusions formed on a cylindrical outer peripheral surface of the filter to be resiliently locked within the mounting grooves, respectively, whereby the filter is resiliently locked within the exhaust filter cover. Therefore, the filter is not rattled by any vibration, and no contact noise is generated.

3 Claims, 3 Drawing Sheets

LOCKING DEVICE FOR EXHAUST FILTER OF VACUUM CLEANER

BACKGROUND OF THE INVENTION

1. Field of the Invention

The present invention relates to a vacuum cleaner, and more particularly, to a locking device for an exhaust filter of a vacuum cleaner, which can securely lock the exhaust filter installed on an outer surface of the vacuum cleaner.

2. Description of the Prior Art

As shown in FIG. 1, a main body 2 of a vacuum cleaner is formed on both side surfaces thereof with exhaust portions 4 through which air is exhausted. The exhaust portions serve to discharge, to the exterior of the vacuum cleaner, air resulting from removal of foreign substances from air containing the foreign substances introduced into the main body of the vacuum cleaner.

The exhaust portions 4 are formed by attaching both filters 4*b* and exhaust filter covers 4*a* to exhaust holes 6*a* formed on both side surfaces of a casing of the main body of the vacuum cleaner, which includes an upper casing 6 and a lower casing 8, as shown in FIG. 2.

Each exhaust filter cover 4*a* is fixed to the casing of the main body by fitting a protrusion 4*c* formed on an outer peripheral surface of the exhaust filter cover into the casing of the main body in which the exhaust holes 6*a* are formed. Here, each filter 4*b* serves to finally filter out the foreign substances, which may be contained in the exhausted air. The filter 4*b* is positioned between the exhaust filter cover 4*a* and the exhaust hole 6*a*.

In general, vibration and noise are generated due to driving of a motor contained within the main body upon operation of the vacuum cleaner. The vibration generated as such is transferred to both the exhaust filter cover 4*a* and the filter 4*b*. According to the conventional constitution, since the filter 4*b* is supported in a state where it is simply inserted between the exhaust filter cover 4*a* and the main body of the vacuum cleaner without an additional support relationship, the filter 4*b* is rattled by such vibration. Accordingly, there are probabilities that the filter 4*b* will come into contact with the cover 4*a* or the main body of the vacuum cleaner in the vicinity of the filter, and any undesired contact noise will be generated due to such contact.

SUMMARY OF THE INVENTION

The present invention is contemplated to solve the above problems in the prior art. An object of the present invention is to provide a locking device for an exhaust filter of a vacuum cleaner, which can perfectly prevent noise generation in the vicinity of the exhaust filter upon operation of the vacuum cleaner by more securely locking the exhaust filter.

According to the present invention for accomplishing the above object, there is provided a locking device for an exhaust filter of a vacuum cleaner, comprising an exhaust filter cover mounted on one side surface of a main body of the vacuum cleaner, and including a plurality of exhaust holes and a plurality of mounting grooves formed on an inner surface of a cylindrical sidewall of the exhaust filter cover; and a filter including a filtering portion for filtering air, and engagement protrusions formed on a cylindrical outer peripheral surface of the filter to be resiliently locked within the mounting grooves, respectively, whereby the filter is resiliently locked within the exhaust filter cover.

According to one embodiment of the present invention, the mounting grooves take a ¬-shape, or bayonet-shape, and the engagement protrusions are inserted into the respective mounting grooves and then rotated in a predetermined direction to be locked within the mounting grooves, respectively.

According to another embodiment of the present invention, engagement protrusions are formed just in front of trail ends of the ¬ -shaped or bayonet-shaped, mounting grooves so as to maintain a state where the engagement protrusions have entered the trail ends of the mounting grooves, respectively.

BRIEF DESCRIPTION OF THE DRAWINGS

The above and other objects and features of the present invention will become apparent from the following description of a preferred embodiment given in conjunction with the accompanying drawings, in which.

DETAILED DESCRIPTION OF THE PREFERRED EMBODIMENTS

Hereinafter, a preferred embodiment of the present invention will be described in detail with reference to the accompanying drawings.

Figure 1:
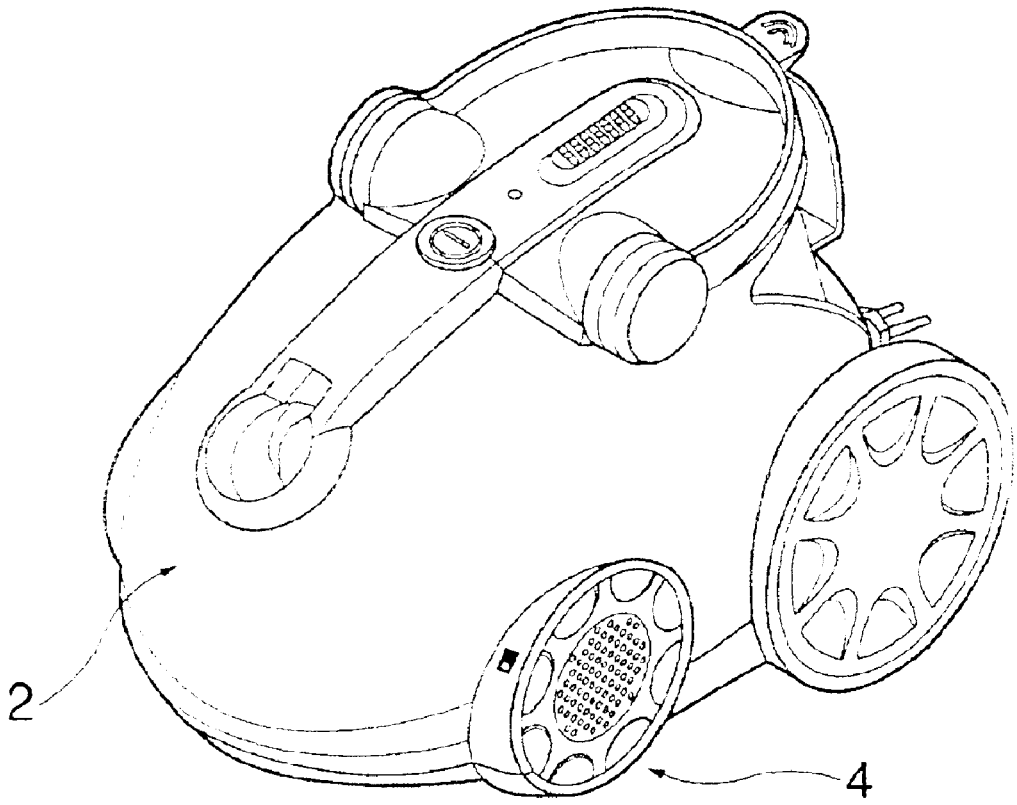
FIG. 1 is a perspective view of a main body of a conventional vacuum cleaner.
Figure 2:
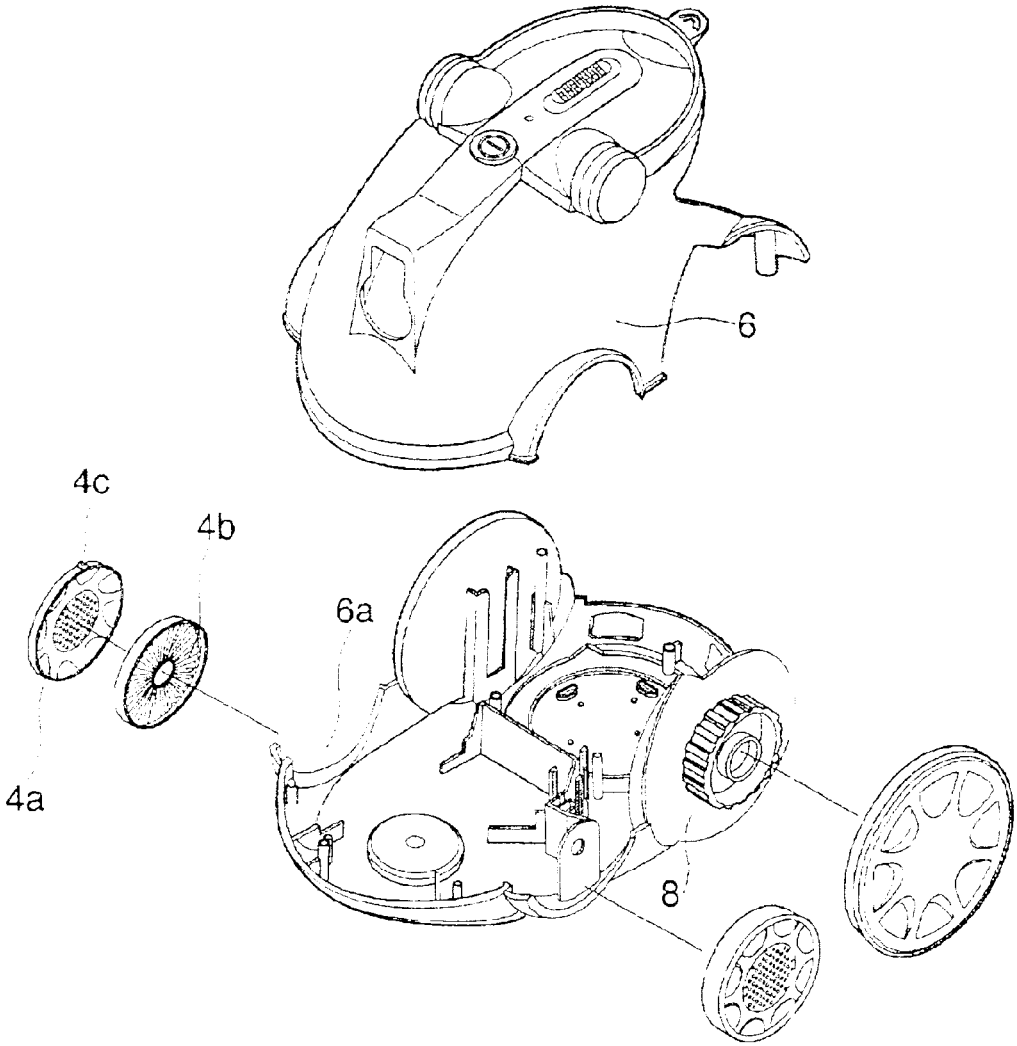
FIG. 2 is an exploded perspective view of the conventional vacuum cleaner, showing the constitution of portions in the vicinity of a conventional exhaust filter thereof.
Figure 3:
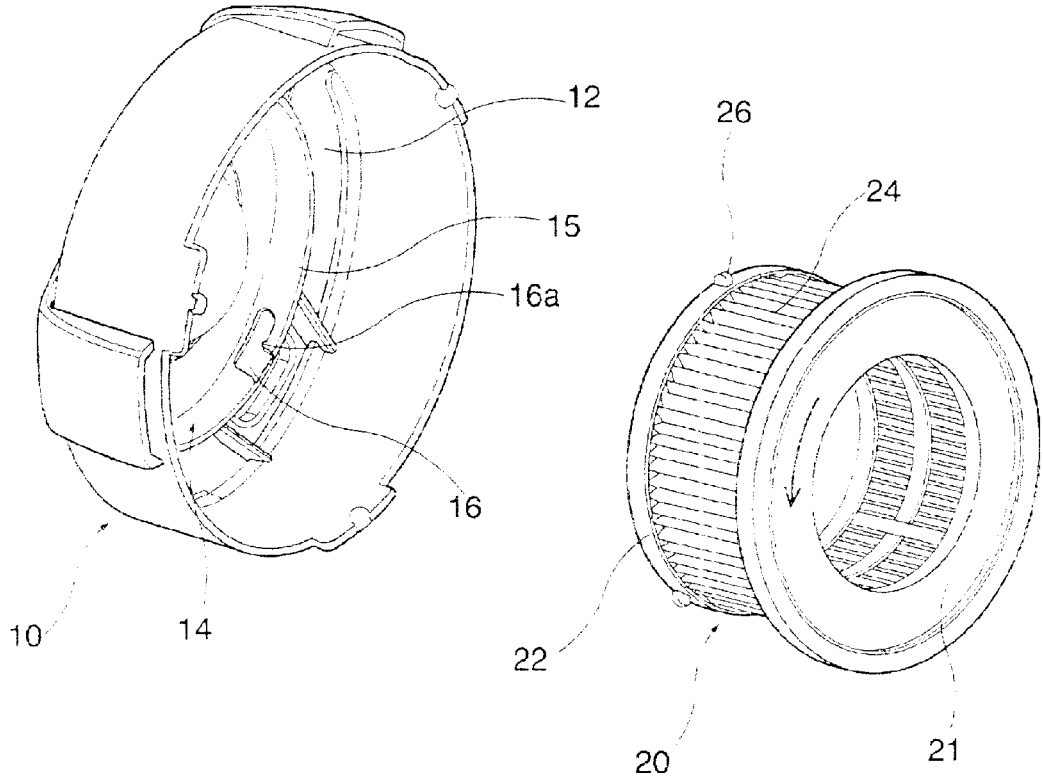
FIG. 3 is an exploded perspective view showing the constitution of an exhaust filter according to the present invention.

As shown in FIG. 3, an exhaust filter cover 10 according to the present invention, which is attached to one side surface of a main body of a vacuum cleaner, is formed with a plurality of exhaust holes 12 through which air is exhausted. In one embodiment, the exhaust filter cover 10 is formed with a circular mounting ring 14 at the center thereof, and the exhaust holes 12 are formed radially outside of a perimeter of the mounting ring 14.

The mounting ring 14 includes a sidewall 15 which can come into close contact with an outer peripheral surface 22 of a filter 20. The outer peripheral surface 22 of the filter 20 is formed to be approximately perpendicular to the substantially vertical side surface of the main body of the vacuum cleaner. Accordingly, the sidewall 15 of the mounting ring 14 of the exhaust filter cover 10 is also formed to be substantially perpendicular to the side surface of the main body of the vacuum cleaner.

Mounting grooves 16 are formed on an inner surface of the sidewall 15. As shown in the figure, the respective mounting grooves 16 take a ¬ -shape, or bayonet-shape, and engagement projections 16*a* protruding into the grooves are formed just in front of trail ends of the mounting grooves 16, respectively.

Next, the cylindrical filter 20 according to the present invention will be described in detail. The filter 20 includes a filtering portion 24 and a support frame portion 21 for supporting the filtering portion, and the support frame portion 21 defines right and left ends of the filter. A left (outer) frame portion of the cylindrical filter 20 defines the outer peripheral surface 22, and the outer peripheral surface 22 is formed with a plurality of engagement protrusions 26.

Next, the engagement relationship between the filter 20 and the exhaust filter cover 10 will be described in detail. The cylindrical outer peripheral surface 22 of the filter 20 is fitted into the mounting ring 14 of the exhaust filter cover 10.

At this time, the outer peripheral surface 22 comes into close contact with the sidewall 15 of the mounting ring 14, and the engagement protrusions 26 formed protrudingly from the outer peripheral surface 22 enter the mounting grooves 16, respectively. In a state where the engagement protrusions 26 have entered the mounting grooves 16 by a predetermined distance, respectively, the filter 20 is rotated in the counter-clockwise direction designated by an arrow so that the engagement protrusions 26 can be engaged with the trail ends of the ¬ -shaped or bayonet-shaped, mounting grooves 16, respectively.

When the engagement protrusions 26 are perfectly engaged with the trail ends, the engagement protrusions 26 are in a state where they are reach the trail ends beyond the engagement projections 16*a* to be resiliently locked by the engagement projections 16*a*, respectively.

According to the present invention, it is a basic technical spirit of the present invention that the engagement protrusions 26 are formed on the outer peripheral surface 22 of the filter 20, and that the filter 20 is securely locked within the mounting ring 14 of the exhaust filter cover 10 by these engagement protrusions.

Within the scope of the basic technical spirit of the present invention, it can be understood by the skilled in the art that various changes and modifications can be made to the present invention.

For example, various changes may be made to the configuration of the mounting grooves 16 within which the engagement protrusions 26 are locked. That is, various changes may be made to the mounting grooves 16 according to the present invention as far as the filter 20 does not accidentally escape from the exhaust filter cover by engagement of the engagement protrusions 26 with the mounting grooves. For example, locking grooves within which the engagement protrusions 26 can be resiliently locked may be formed on the inner surface of the sidewall 15 of the mounting ring 14, so that the filter 20 can be securely locked within the exhaust filter cover 10.

According to the present invention as described above, the exhaust filter cover 10 can be mounted on the side surface of the main body of the vacuum cleaner in a state where the filter 20 is perfectly mounted on the exhaust filter cover 10. Therefore, it can be expected to obtain an advantage in that noise due to contact of the filter 20 with the other parts is not generated since the filter 20 can be securely supported even against external vibration and can be not rattled by any vibration generated during operation of the vacuum cleaner.

What is claimed is:

1. A locking device for an exhaust filter of a vacuum cleaner, comprising:

an exhaust filter cover mounted on one side surface of a main body of the vacuum cleaner, and including a plurality of exhaust holes and a plurality of mounting grooves formed on an inner surface of a cylindrical sidewall of the exhaust filter cover; and a filter including a filtering portion for filtering air, and engagement protrusions formed on a cylindrical outer peripheral surface of the filter to be resiliently locked within the mounting grooves, respectively, whereby the filter is resiliently locked within the exhaust filter cover.

2. The locking device as claimed in claim 1, wherein the mounting grooves take a bayonet-shape, and the engagement protrusions are inserted into the respective mounting grooves and then rotated in a predetermined direction to be locked within the respective mounting grooves.

3. The locking device as claimed in claim 2, wherein engagement projections are formed just in front of trail ends of the bayonet-shaped mounting grooves so as to maintain a state where the engagement protrusions have entered the trail ends of the mounting grooves, respectively.

* * * * *